US010297223B2

(12) United States Patent
Mamba et al.

(10) Patent No.: US 10,297,223 B2
(45) Date of Patent: May 21, 2019

(54) DISPLAY DEVICE AND SYSTEM WITH SWITCHING TO EXTERNAL POWER SUPPLY CIRCUIT

(71) Applicant: Japan Display Inc., Tokyo (JP)

(72) Inventors: Norio Mamba, Tokyo (JP); Takeshi Shibata, Tokyo (JP); Shouji Nagao, Tokyo (JP)

(73) Assignee: Japan Display Inc., Tokyo (JP)

( * ) Notice: Subject to any disclaimer, the term of this patent is extended or adjusted under 35 U.S.C. 154(b) by 329 days.

(21) Appl. No.: 15/203,959

(22) Filed: Jul. 7, 2016

(65) Prior Publication Data

US 2017/0011691 A1 Jan. 12, 2017

(30) Foreign Application Priority Data

Jul. 9, 2015 (JP) ..... 2015-137721

(51) Int. Cl.
*G09G 5/00* (2006.01)
*G09G 3/36* (2006.01)

(52) U.S. Cl.
CPC ..... *G09G 3/3696* (2013.01); *G09G 3/3677* (2013.01); *G09G 2330/04* (2013.01)

(58) Field of Classification Search
CPC ..... G09G 2330/027; G09G 2330/04; G09G 3/3696; G09G 3/3677
USPC ..... 345/211
See application file for complete search history.

(56) References Cited

U.S. PATENT DOCUMENTS

2007/0279950 A1* 12/2007 Sugiyama ..... H02M 3/07 363/59
2009/0256493 A1* 10/2009 Tonomura ..... G09G 3/006 315/291
2010/0182305 A1* 7/2010 Fang ..... G09G 3/3677 345/212
2014/0298065 A1* 10/2014 Sakamaki ..... G06F 1/1626 713/323
2014/0340382 A1* 11/2014 Sawabe ..... G09G 3/3696 345/212
2015/0309550 A1* 10/2015 Shirakami ..... G09G 3/3696 713/300

FOREIGN PATENT DOCUMENTS

JP 2004-226597 A 8/2004

* cited by examiner

*Primary Examiner* — Adam J Snyder
(74) *Attorney, Agent, or Firm* — Michael Best & Friedrich LLP

(57) ABSTRACT

A display device includes a gate scanning circuit and a driver IC. The driver IC includes a voltage detection circuit for detecting a voltage level of an external power supply, a voltage generation circuit for generating the voltage for driving the gate line, a switching circuit for switching between the output voltage of the voltage generation circuit and the voltage of the external power supply, and a drive circuit. Upon detection of the voltage outside of the predetermined voltage range by the voltage detection circuit, the switching circuit supplies the voltage of the external power supply to the gate scanning circuit. The gate scanning circuit selects all gate lines for outputting the voltage of the external power supply. The drive circuit supplies the GND level to all the source lines.

16 Claims, 10 Drawing Sheets

DISPLAY DEVICE AND SYSTEM WITH SWITCHING TO EXTERNAL POWER SUPPLY CIRCUIT

CLAIM OF PRIORITY

The present application claims priority from Japanese patent application JP2015-137721 filed on Jul. 9, 2015, the content of which is hereby incorporated by reference into this application.

BACKGROUND

The present invention relates to a display device, for example, which is applicable to the one configured to detect power supply voltage drop.

In the case where the liquid crystal display panel of the liquid crystal display device is in a power OFF state, the pixel charge will be gradually discharged, the process of which causes an afterimage. In the case where DC voltage is applied to the liquid crystal layer of the pixel for a long period of time, the liquid crystal life will be reduced. The aforementioned residual charge is required to be immediately discharged. The power OFF state is detected under observation of the power supply voltage drop. Based on the detection results, the switching transistor for each pixel of the liquid crystal display panel is turned ON simultaneously so as to discharge storage data of the pixel to the data line via the switching transistor. This may immediately clear the displayed image to remove the afterimage.

Japanese Unexamined Patent Application Publication No. 2004-226597 proposes provision of the afterimage removing circuit such as the circuit for detecting the power supply voltage drop in the liquid crystal display device for a main body of the liquid crystal display device outside the liquid crystal display panel, or in the liquid crystal display panel.

SUMMARY

As disclosed in Japanese Unexamined Patent Application Publication No. 2004-226597, the afterimage removing circuit provided for the main body of the display device outside the display panel may increase the number of components for constituting the display device, or the one provided in the display panel may increase the area of the part other than the display region.

Other tasks and new features will be clarified from description and drawings of the disclosure.

The present invention provides a display device which includes a gate line, a source line, a gate scanning circuit for scanning the gate line, and a driver IC. The driver IC includes a voltage detection circuit for detecting a voltage level of an external power supply, a voltage generation circuit for generating a voltage at which the gate line is driven, a switching circuit for switching between an output voltage of the voltage generation circuit and a voltage of the external power supply, and a drive circuit for driving the source line. The switching circuit applies the output voltage of the voltage generation circuit to the gate scanning circuit, the gate scanning circuit selects the gate line sequentially to output the voltage of the voltage generation circuit, and the drive circuit applies the voltage corresponding to a video signal to the source line when the voltage detection circuit detects a voltage within a predetermined voltage range. The switching circuit applies the voltage of the external power supply to the gate scanning circuit, the gate scanning circuit selects all the gate lines to output the voltage of the external power supply, and the drive circuit supplies GND level to all the source lines when the voltage detection circuit detects the voltage outside of the predetermined voltage range.

DETAILED DESCRIPTION

Figure 1:
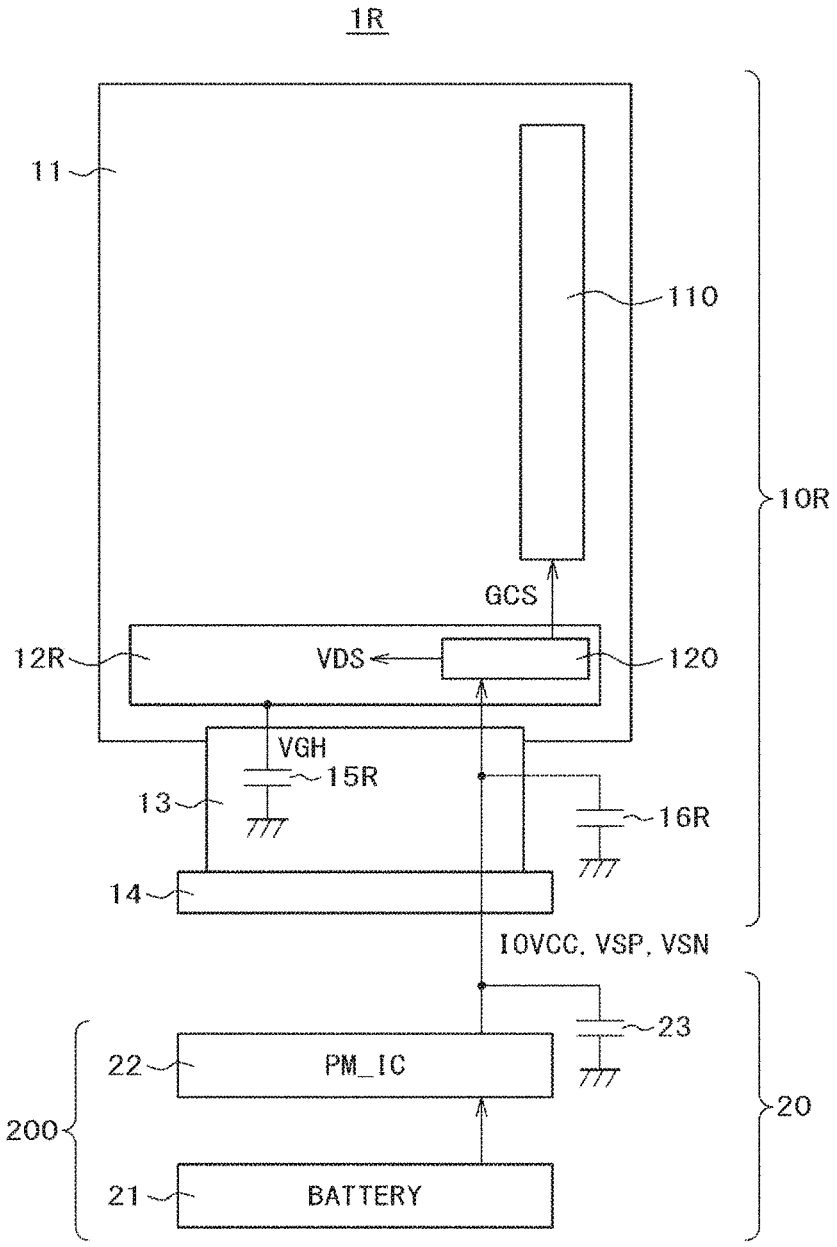
FIG. 1 is a schematic block diagram showing a structure of a system according to a first comparative example.

An embodiment, comparative examples, and an example will be described referring to the drawings. It is noted that the disclosure is a mere example, and modifications which can be easily assumed by those who are skilled in the art may be contained in the scope of the present invention. The width, thickness, and shape of the respective components of the disclosed structure in the drawing may be schematically expressed for the purpose of clarifying the description. The drawings, therefore, are not intended to restrict interpretation of the present invention. In the specification and the drawings, the same components as those already described will be designated with the same reference numerals, and explanations thereof, thus will be omitted.

Comparative Examples

Prior to explanation of the disclosure, the first technique (first comparative example) will be described referring to FIGS. 1 and 2.

Figure 2:
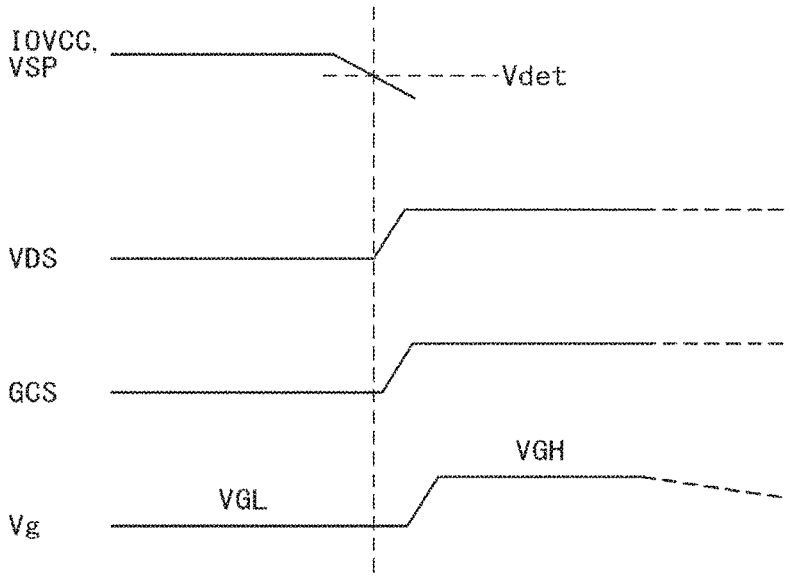
FIG. 2 is a timing chart of the system according to the first comparative example.

FIG. 1 is a schematic block diagram showing a structure of the system according to the first comparative example. FIG. 2 is a timing chart of the system according to the first comparative example.

A system 1R according to the first comparative example includes a display device 10R, a battery 21, a power management IC 22, and the like. Three types of power supply voltages are input to the display device 10R, that is, the logic power supply voltage (hereinafter referred to as IOVCC), the analog positive power supply voltage (hereinafter referred to as VSP), and the analog negative power supply voltage (hereinafter referred to as VSN). The IOVCC, VSP, and VSN are set to 1.8 V, +5.0 V, and −5.0 V, respectively. The display device 10R includes a display panel 11, a driver IC 12R, a flexible print circuit substrate (Flexible Print Circuit, hereinafter referred to as FPC) 13, a connector 14, and the like. The FPC 13 includes capacitors 15R, 16R for stabilization. A power-supply circuit 200 (battery 21, power management IC 22) at a system side 20 also includes a capacitor 23 for stabilization.

The driver IC 12R includes a voltage detection circuit 120 for detecting the voltage level drop of the input power. When the voltage detection circuit 120 detects the voltage drop, it outputs a voltage detection signal (VDS) at High level. Definition of the voltage drop is that the input power voltage becomes equal to or lower than the predetermined voltage (detection voltage, hereinafter referred to as Vdet). The driver IC 12R then determines that the power-supply circuit 200 at the system side 20 has abnormality, and stops displaying. The driver IC 12R includes a discharging function for refresh operation where GND potential (black voltage in the normally black mode) is written just before stopping the display in order to prevent the burn-in of the liquid crystal caused by the residual charge. Degree of the residual charge after the display is associated with the image just before stopping the display.

Upon execution of the discharging function, the driver IC 12R applies the high voltage (hereinafter referred to as VGH) to a gate scanning circuit 110 of the display panel 11 from the capacitor 15R. (Hereinafter the gate voltage is referred as Vg). The high voltage VGH is generated inside the driver IC 12R. And then all gate lines are selected based on the gate control signal (GCS) at high level for executing the discharging. The capacity of the capacitor 15R is set to be in the range from 1 to 2.2 μF.

The system according to the second technique (second comparative example) examined prior to the disclosure will be described referring to FIGS. 3 to 4B.

Figure 3:
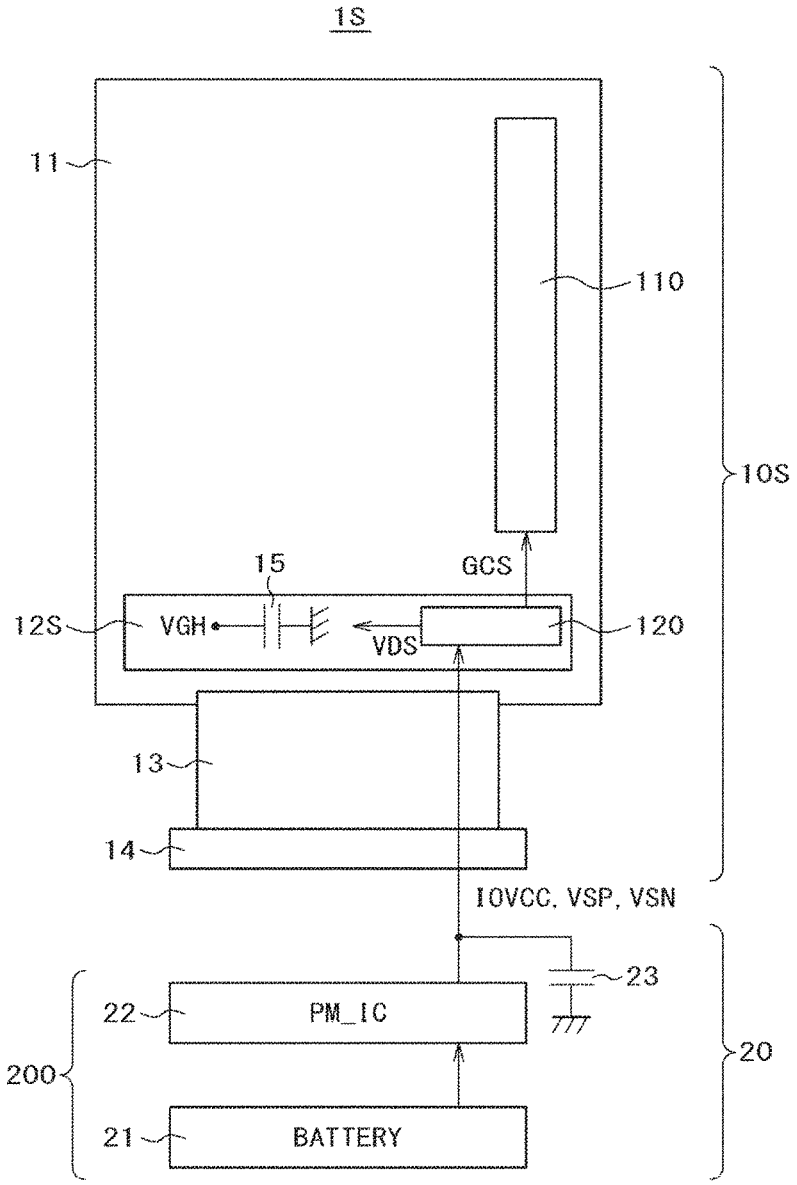
FIG. 3 is a schematic block diagram showing a structure of a system according to a second comparative example.
Figure 4A:
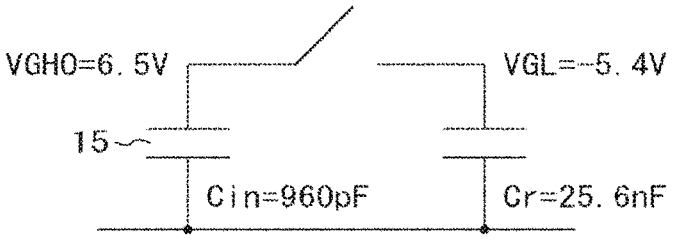
FIG. 4A is an explanatory view indicating a problem of the system according to the second comparative example.
Figure 4B:
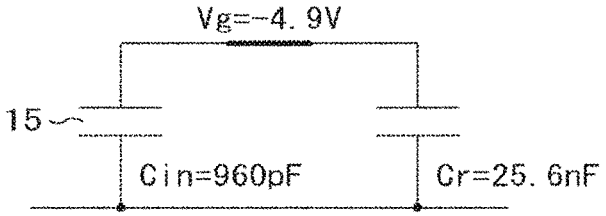
FIG. 4B is an explanatory view indicating a problem of the system according to the second comparative example.

FIG. 3 is a schematic block diagram showing a structure of the system according to the second comparative example. FIGS. 4A and 4B are equivalent circuits indicating the system according to the second comparative example. FIG. 4A represents equivalent circuit having capacitor 15, and capacitor Cr which is a total capacitance of all the gate lines in the normal display state. FIG. 4B represents equivalent circuit having capacitor 15, and capacitor Cr which is a total capacitance of all the gate lines in the state where voltage drop is detected.

A system 1S according to the second comparative example is configured that the driver IC 12S has a built-in mounting component such as a capacitor for reducing the number of components mounted on the FPC 13. Besides the aforementioned feature, it has the same structure as that of the system 1R according to the first comparative example. The capacity (hereinafter referred to as Cin) of the capacitor 15 for VGH in the driver IC 12S have to be 1 nF or so at most. The Cin is equal to or less than 1/1000 of the capacity of the capacitor 15R according to the first comparative example. Referring to FIG. 4A, assuming that there are 279 lines, and the capacity for each line is approximately 20 pF, the total capacity (hereinafter referred to as Cr) for all gate lines is approximately 25.6 nF. For one example, the screen includes 1280 lines. In general, the single line is selected while displaying. In the case of the power source abnormality, all of the 1280 lines have to be selected. Therefore, the capacity of all the gate lines is calculated as a total capacitance of 1279 lines. It is assumed that the voltage of the capacitor 15 (hereinafter referred to as VGHO) is set to 6.5 V, the Cin is set to 960 pF, and the low gate voltage (hereinafter referred to as VGL) is set to −5.4 V. As FIG. 4B shows, in the case where the charge is supplied to all the gate lines from the capacitor 15 upon detection of the voltage drop, the Vg becomes equal to or lower than GND (−4.9 V). That is, upon application of the VGH to all the gate lines from the capacitor 15 for discharging, the pixel transistors keep turning OFF until the Vg rises to turn on the pixel transistors. There may cause the risk that the black voltage cannot be written, and the charge is remained in pixels, resulting in burn-in of liquid crystal and causes image quality deterioration.

The system according to the first or the second comparative example is intended to suppress increase in the number of the components and increase in the area of the part of the display panel other than the display region, respectively by allowing the afterimage removing circuit like the one for detecting the power supply voltage drop to be built in the driver IC.

Embodiment

A system according to an embodiment will be described referring to FIGS. 5 and 6.

Figure 5:
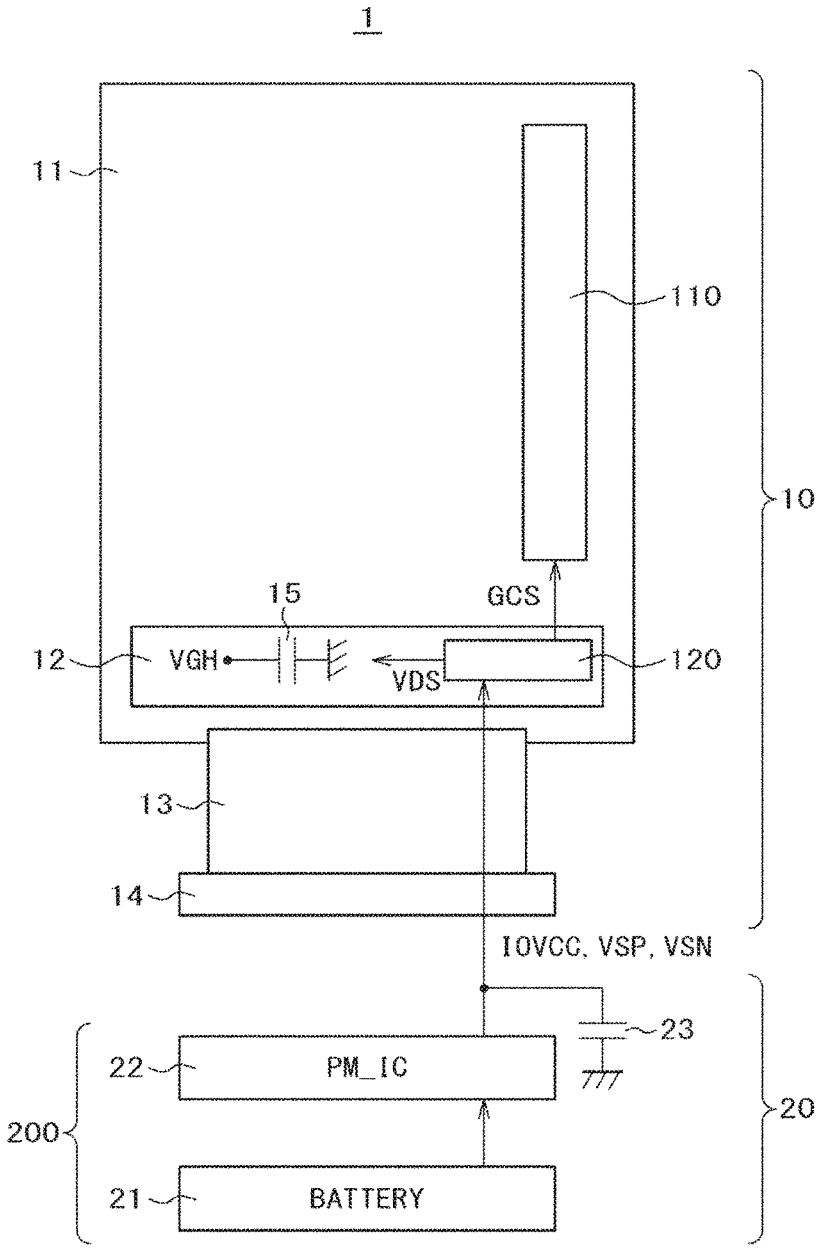
FIG. 5 is a schematic block diagram showing a structure of a system according to an embodiment.
Figure 6:
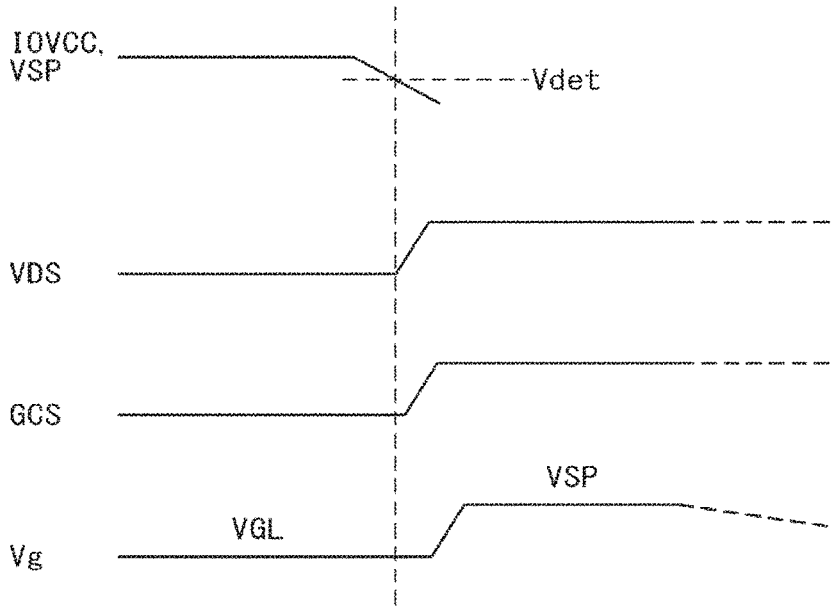
FIG. 6 is a timing chart of the system according to the embodiment.

FIG. 5 is a schematic block diagram representing a structure of the system according to the embodiment. FIG. 6 is a timing chart of the system according to the embodiment.

A system 1 according to the embodiment includes a display device 10, the battery 21, the power management IC 22, and the like. The display device 10 includes the display panel 11, the driver IC 12, the FPC 13, the connector 14, and the like. The power-supply circuit 200 (the battery 21 and the power management IC 22) at the system side 20 are provided with the capacitor 23 for stabilization. The display device 10 is supplied with the power IOVCC, VSP, and VSN.

The driver IC 12 has the voltage detection circuit 120 configured to detect drop in the input power level, and the capacitor 15 for VGH, both of which are built therein. When the voltage detection circuit 120 detects the voltage drop, it outputs a voltage detection signal (VDS) at High level. Definition of the voltage drop is that the input power voltage become equal to or lower than the predetermined voltage (detection voltage, hereinafter referred to as Vdet). The driver IC 12 then determines that abnormality has occurred in the power-supply circuit 200 at the system side 20, and stops displaying. When the voltage detection circuit 120 detects the voltage out of the predetermined range, for example, equal to or lower than the predetermined voltage (detection voltage, hereinafter referred to as Vdet), it outputs a voltage detection signal (VDS) at low level. The driver IC 12 has the discharging function for refreshing operation to write GND potential (black voltage in the normally black mode) just before stopping the display for the purpose of preventing burn-in of the liquid crystal caused by the residual charge. Degree of the residual charge after the display is associated with the image just before stopping the display.

When the discharging function is under operation, the driver IC 12 is supplied with VSP from the capacitor 23 mounted outside the display device 10 to the gate scanning circuit 110 of the display panel 11, and selects all the gate lines based on the gate control signal (GCS) at High level for discharging. It is also possible to configure the logic circuit to execute the discharging by selecting all the gate lines based on the gate control signal (GCS) at Low level. That is, the driver IC 12 switches the power supply from the VGH generated inside the driver IC 12 to the VSP supplied from outside the display device 10 for controlling the Vg of the gate scanning circuit 110.

The effect derived from the system according to the embodiment will be described referring to FIGS. 7A and 7B.

Figure 7A:
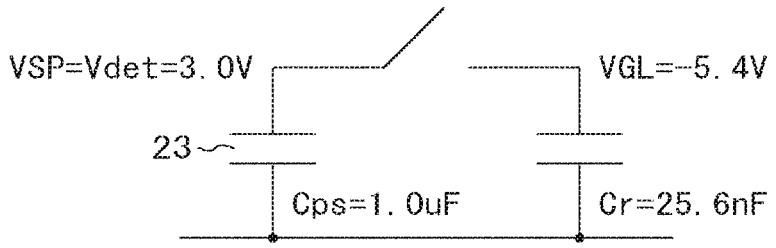
FIG. 7A is an equivalent circuit indicating the effect derived from the system according to the embodiment.
Figure 7B:
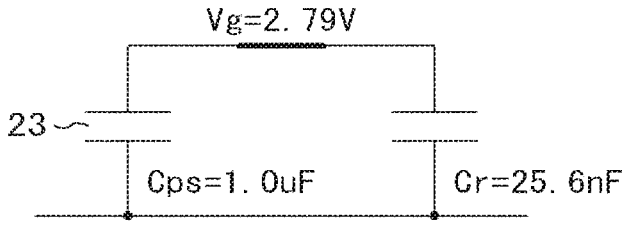
FIG. 7B is an equivalent circuit indicating the effect derived from the system according to the embodiment.

FIGS. 7A and 7B are equivalent circuits indicating the effect derived from the system according to the embodiment. FIG. 7A represents the equivalent circuit having capacitor 15, and capacitor Cr which is a total capacity of all gate lines in the normal display state, and FIG. 7B represents the equivalent circuit having capacitor 15, and capacitor Cr which is a total capacity of all gate lines upon detection of the voltage drop.

Referring to FIG. 7A, assuming that there are 1279 lines, and the capacity for each line is approximately 20 pF, the Cr is about 25.6 nF. It is also assumed that the capacity of the capacitor 23 (Cps) is set to 1.0 μF, the voltage (VSP=Vdet) of the stabilization capacitor 23 is set to 3.0 V, and the VGL is set to −5.4 V. Referring to FIG. 7B, in the case of supply of the charge from the capacitor 23 to all the gate lines upon detection of the voltage drop, the Vg becomes 2.79 V. In other words, the resultant Vg (2.79) allows writing of the black voltage to the pixel electrode in the case where the source line voltage (hereinafter referred to as Vs) is 0V(GND), and the common electrode voltage (hereinafter referred to as Vcom) is 0V (GND).

It is possible to have the afterimage removing circuit, for example, the circuit for detecting the power-supply voltage drop built in the driver IC. This makes it possible to suppress increase in the number of components of the display device, and increase in the area of the part of the display panel other than the display region.

Example

The system and the driver IC according to the embodiment will be described referring to FIGS. 8 to 10.

Figure 8:
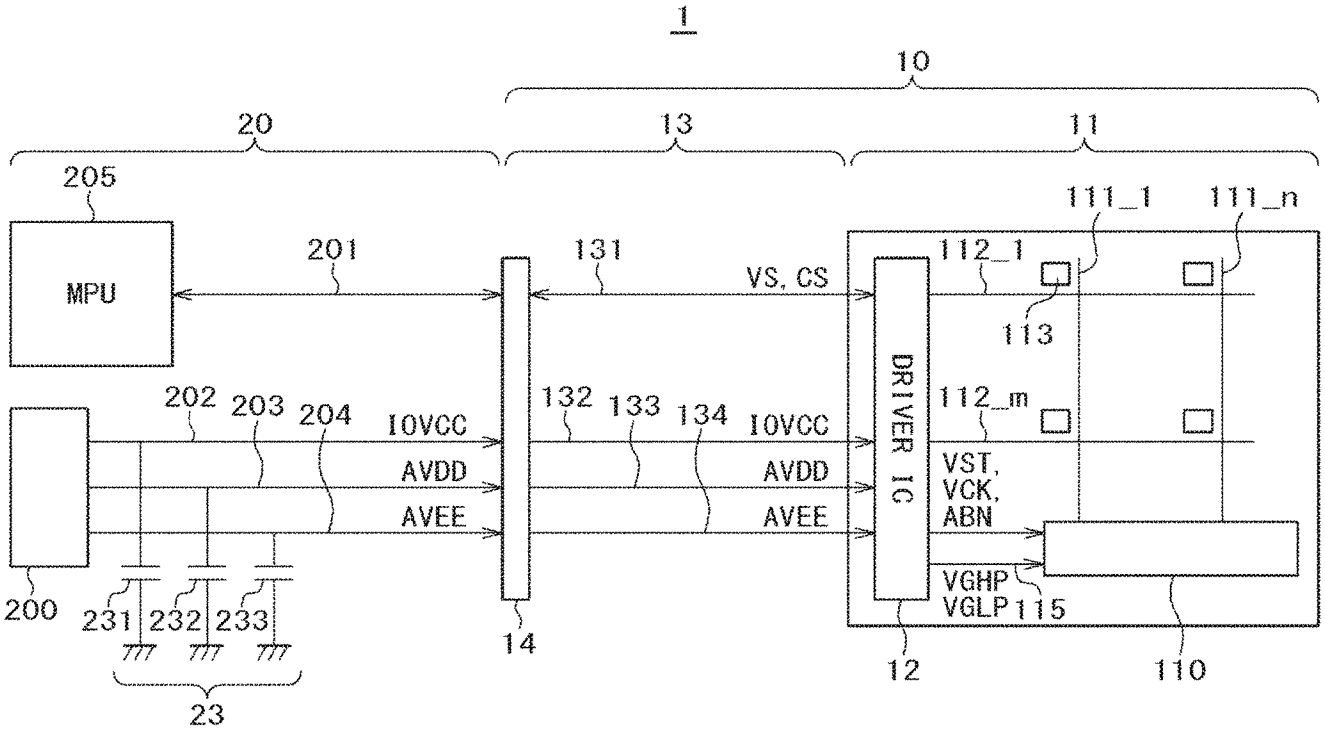
FIG. 8 is a schematic block diagram showing a structure of a system according to an example.

FIG. 8 shows a structure of the system according to the embodiment. FIG. 9 is a block diagram of the driver IC according to the embodiment. FIG. 10 is a timing chart of the display device according to the embodiment.

The system 1 according to the embodiment includes the display device 10 and the external unit (system side) 20. The system 1 is a mobile device, for example, a smartphone and a tablet type terminal. The display device 10 comprises the display panel 11, the driver IC 12, the FPC 13, the connector 14, and the like. The display panel 11 includes an array substrate, a counter substrate, liquid crystal interposed between the array substrate and the counter substrate, a polarizing plate attached to the array substrate, and a polarizing plate attached to the counter substrate, which are not shown. The display panel 11 has the array substrate provided with the gate scanning circuit 110, gate lines 111_1 to **111_*n*, source lines 112_1 to 112_*n*, and pixels 113 on the array substrate. The FPC 13 includes a signal line 131 for transferring a video signal (VS) and a control signal (CS), a power-supply line 132 for applying the IOVCC to the driver IC 12, a power-supply line 133 for applying positive voltage for analog power supply (hereinafter referred to as AVDD) to the driver IC 12, and a power-supply line 134 for applying negative voltage for analog power supply (hereinafter referred to as AVEE) to the driver IC 12. The IOVCC is set to 1.8 V, the AVDD is set to +5.0 V, and the AVEE is set to −5.0 V, respectively. The AVDD corresponds to the VSP, and the AVEE corresponds to the VSN as described above. The external unit 20 includes the power-supply circuit 200 (the battery 21 and the power management IC 22), the capacitor 23 for power supply, and an MPU (Micro Processor Unit) 205 for controlling the display device 10. The capacitor 23 for power supply includes a capacitor 231 for IOVCC, a capacitor 232 for AVDD, and a capacitor 233 for AVEE, respectively, for stabilization. The MPU 205 transfers the video signal and the control signal via the signal line 201 and the connector 14. The power-supply circuit 200 supplies the power supply line 202 with the IOVCC, the power supply line 203 with the AVDD, and the power supply line 204 with the AVEE, respectively. Each of the power supply lines 202, 203, and 204 are coupled to the connector 14 respectively. The gate scanning circuit 110 comprises a thin film transistor on the array substrate, and is controlled by a panel gate high voltage (hereinafter referred to as VGHP), a panel gate low voltage (hereinafter referred to as VGLP), a start signal (VST), the shift clock signal (VCK), an abnormality detection signal (ABN), and the like. The shift clock signal (VCK) includes a first shift clock signal (VCK1) and a second shift clock signal (VCK2**). The abnormality detection signal (ABN) is the same as the gate control signal (GCS) as described above.

Figure 9:
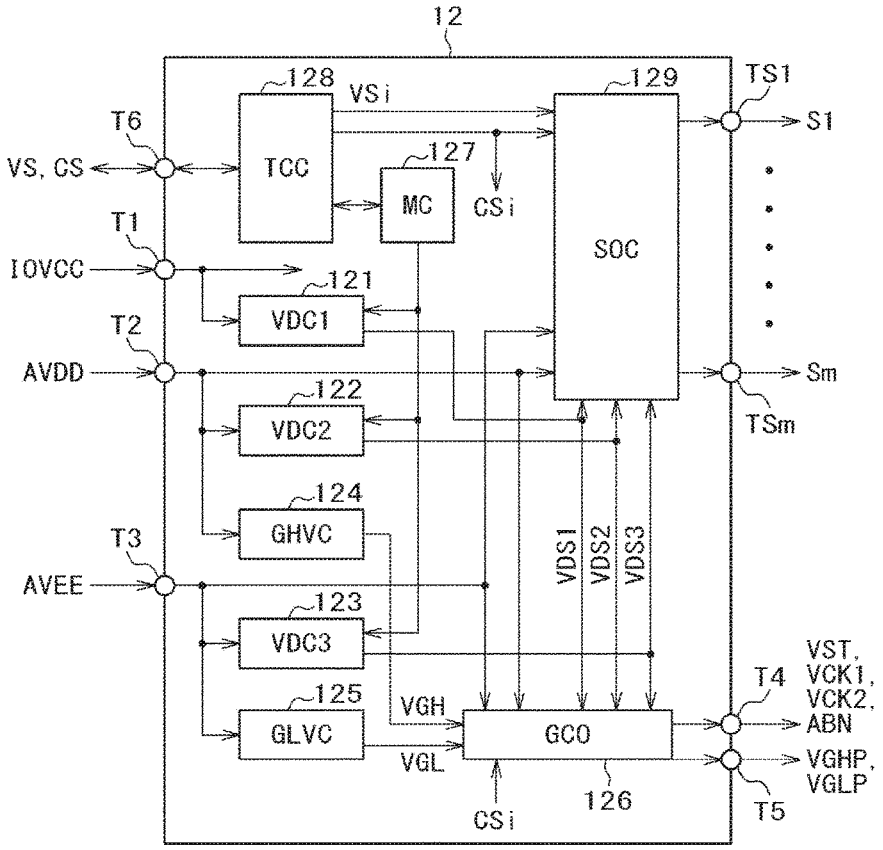
FIG. 9 is a block diagram of a driver IC according to the example.

As FIG. 9 shows, the driver IC 12 includes a first voltage detection circuit (VDC1) 121, a second voltage detection circuit (VDC2) 122, a third voltage detection circuit (VDC3) 123, a gate high-voltage generation circuit (GHVC) 124, a gate low-voltage generation circuit (GLVC) 125, a gate control signal output circuit (GCO) 126, a storage circuit (MC) 127, a signal processing-timing control circuit (hereinafter referred to as TCC) 128, and a source output circuit (SOC) 129. The driver IC 12 is mounted on the array substrate of the display panel 11 by using a COG (Chip on Glass) technique.

The IOVCC input to an external terminal T1 is used for a power supply of the logic circuit inside the driver IC 12. The AVDD input to an external terminal T2 is used for the gate high-voltage generation circuit 124 and the source output circuit 129. The AVEE input to the external terminal T2 is used for the gate low-voltage generation circuit 125 and the source output circuit 129.

The gate high-voltage generation circuit 124 boosts the AVDD to generate the VGH. The gate low-voltage generation circuit 125 boosts the AVEE to generate the VGL. This makes it possible to lower the voltage of the power-supply circuit 200 to achieve the low voltage operation of the system.

The first voltage detection circuit 121 serves as the voltage detection circuit for IOVCC. The second voltage detection circuit 122 serves as the voltage detection circuit for AVDD. The third voltage detection circuit 123 serves as the voltage detection circuit for AVEE. Each Vdet level and ON/OFF state of the detection function of the first voltage detection circuit 121, the second voltage detection circuit 122, and the third voltage detection circuit 123 is set, respectively based on values set in the storage circuit 127. The first voltage detection circuit 121, the second voltage detection circuit 122, and the third voltage detection circuit 123 are configured to set the first voltage detection signal (VDS1), the second voltage detection signal (VDS2), and the third voltage detection signal (VDS3) at High level (first level), respectively in the case where the input voltage is equal to or lower than the Vdet (outside of the predetermined voltage range). The first voltage detection circuit 121, the second voltage detection circuit 122, and the third voltage detection circuit 123 are configured to set the first voltage detection signal (VDS1), the second voltage detection signal (VDS2), and the third voltage detection signal (VDS3) at Low level (second level), respectively in the case where the input voltage is higher than the Vdet (within the predetermined voltage range). In the case of negative input voltage, the absolute value thereof will be compared with the Vdet.

That is, if the absolute value of the negative input voltage is equal to or smaller than the Vdet, it is determined to be equal to or lower than the Vdet. Likewise, if the absolute value of the negative input voltage is larger than the Vdet, it is determined to be higher than the Vdet. If each detection function of the first voltage detection circuit 121, the second voltage detection circuit 122, and the third voltage detection circuit 123 is in the OFF state, the first voltage detection signal (VDS1), the second voltage detection signal (VDS2), and the third voltage detection signal (VDS3) are set at Low level (second level). If at least one of the first voltage detection signal (VDS1), the second voltage detection signal (VDS2), and the third voltage detection signal (VDS3) is set at High level, the gate control signal output circuit 126 detects abnormality in the power supply. Upon detection of the power supply abnormality, the gate control signal output circuit 126 sets the abnormality detection signal (ABN) at High level to the external terminal T4, and outputs AVDD and AVEE as VGHP and VGLP to the external terminal T5 in place of the VGH and VGL. In the normal state of the power supply, the gate control signal output circuit 126 sets the abnormality detection signal (ABN) at Low level to the external terminal T4, and outputs the VGH and VGL to the external terminal T5 as VGHP and VGLP, respectively. In the normal power supply state, the gate control signal output circuit 126 outputs the start signal (VST), the first shift clock signal (VCK1), and the second shift clock signal (VCK2) to the external terminal T4. Each set value of the ON/OFF detection function of the first voltage detection circuit 121, the second voltage detection circuit 122, and the third voltage detection circuit 123 may determine any one or any combination of the first voltage detection signal (VDS1), the second voltage detection signal (VDS2), and the third voltage detection signal (VDS3) for detection of the power supply abnormality performed by the gate control signal output circuit 126.

Based on the control signal (CS) on the external terminal T6, the TCC 128 generates the control signal required for the gate scanning circuit 110 and the source output circuit 129. The storage circuit 127 is configured to allow data to be written from the MPU 205 via the signal line 131 and the TCC 128. The storage circuit 127 may be configured as a volatile memory such as RAM and register, a non-volatile memory such as EEPROM and flash memory, or a combination of the volatile and non-volatile memories.

In the case where at least one of the first voltage detection signal (VDS1), the second voltage detection signal (VDS2), and the third voltage detection signal (VDS3) is set at High level, the source output circuit 129 detects the power supply abnormality, and outputs GND level (black voltage in the normally black mode) to all the external terminals TS1 to Tsm. In the normal state of the power supply, the source output circuit 129 converts the video signal into the analog signal for outputting to the external terminals TS1 to TSm. Each set value of the ON/OFF detection function of the first voltage detection circuit 121, the second voltage detection circuit 122, and the third voltage detection circuit 123 may determine any one of the first voltage detection signal (VDS1), the second voltage detection signal (VDS2), and the third voltage detection signal (VDS3) for detection of the power supply abnormality performed by the source output circuit 129. The source output circuit 129 may be configured to detect the power supply abnormality by receiving the abnormality detection signal (ABN) output from the gate control signal output circuit 126.

Each of the external terminals T4, T5, T6 is constituted by a plurality of terminals, respectively. The driver IC 12 is provided with an external terminal for inputting a not shown reference potential (GND).

Description will be made with respect to operations of the system according to the embodiment upon notification of the power supply abnormality in response to the condition where the AVEE becomes equal to or lower than the predetermined Vdet (high potential, and outside of the predetermined voltage range).

Figure 10:
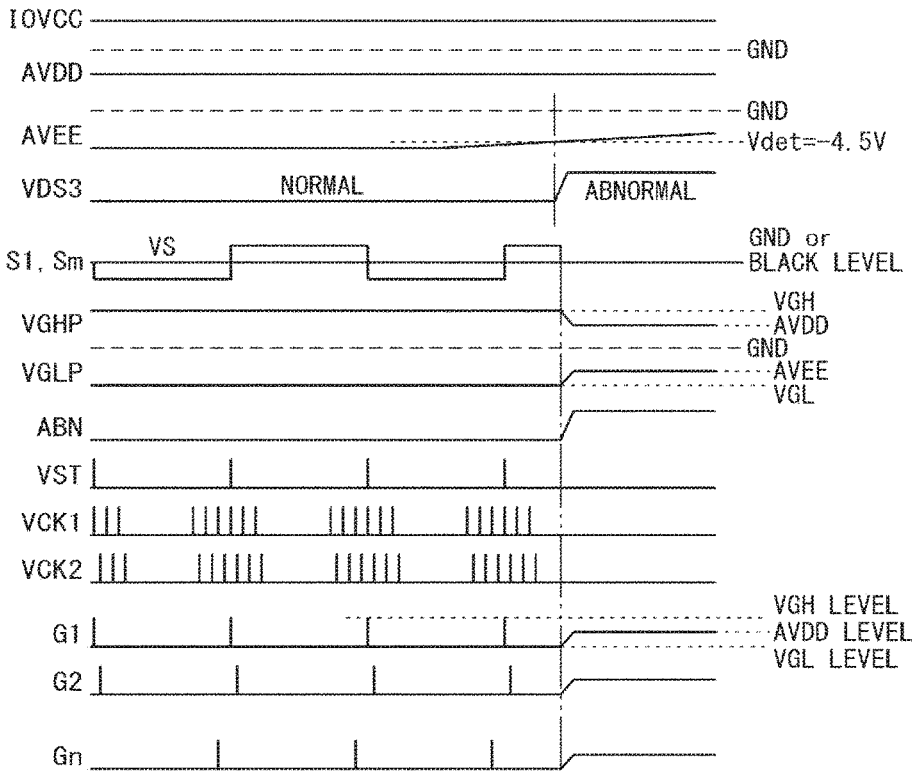
FIG. 10 is a timing chart of a display device according to the example.

Referring to FIG. 10, in the normal state of the power supply, the third voltage detection signal (VDS3) is at Low level, and the abnormality detection signal (ABN) is also at Low level. The gate control signal output circuit 126 outputs the start signal (VST), the first shift clock signal (VCK1), and the second shift clock signal (VCK2) to the gate scanning circuit 110. The gate scanning circuit 110 outputs the first gate signal (G1) at High level to the gate line 111_1, the second gate signal (G2) at High level to the gate line 111_2, and the nth gate signal (Gn) at High level to the gate line **111_*n*, sequentially. The G1 to Gn at High level correspond to the VGH, and the G1 to Gn at Low level correspond to the VGL, respectively. The source output circuit 129 outputs the first source signal (S1) to the source line 112_1, and the mth source signal (Sm) to the source line 112_*m*, respectively. Then the source signal is written into the pixel for each line for display. In the case of column inversion drive, each polarity of the S1** to Sm will be inverted at every frame (between the start signals (VST)).

It is assumed that the third voltage detection signal (VDS3) is set at High level if the AVEE drops (as the potential approaches GND) to be equal to or lower than −4.5 V (Vdet=−4.5 V). If the third voltage detection signal (VDS3) is set at High level, the source output circuit 129 outputs GND signals to all the source lines 112_1 to **112_*m*, and the gate control signal output circuit 126 switches VGHP/VGLP from VGH/VGL generated by the gate high voltage generation circuit 124 and the gate low voltage generation circuit 125 to the AVDD/AVEE as the external power supply for setting the abnormality detection signal (ABN) at High level. The gate scanning circuit 110 sets all the gate lines 111_1 to 111_*n* at High level in response to the abnormality detection signal (ABN) set at High level. The gate lines 111_1 to 111_*n*** at High level correspond to the AVDD. This makes it possible to extract charges from all pixels.

Likewise as the above description, if the IOVCC or AVDD becomes equal to or lower than the predetermined voltage (outside of the predetermined voltage range), the pixel charge may be discharged by the voltage detection signal and the abnormality detection signal. For example, the Vdet of the IOVCC may be set to 1.2 V, and the Vdet of the AVDD may be set to 4 V. In spite of drop in the AVDD, the voltage may be held by the stabilization capacitor 232 so as to ensure application of the AVDD to the gate line within the retention period. For example, the retention period may be set to approximately 1 ms so as to allow the pixel charge extraction in such retention period.

Unlike the first comparative example, the capacitor for retaining the internal voltage of the driver IC does not have to be disposed near the driver IC. It is not necessary to provide the driver IC with the external terminal for connecting the capacitor which retains the internal voltage of the driver IC. Even in the case where there is no external component in the display device, the discharging function is effective in the voltage abnormal state. This makes it possible to contribute to the cost reduction of the display module (display device). It is also possible to prevent burn-in caused by the residual charge in the abnormal voltage state, thus preventing deterioration in image quality on the display panel.

The structure having the driver IC 12 and the gate scanning circuit 110 separately disposed has been described. However, it is possible to have the gate scanning circuit built in the driver IC.

In the case where the input voltage is equal to or lower than the Vdet (outside of the predetermined voltage range), each of the first voltage detection circuit 121, the second voltage detection circuit 122, and the third voltage detection circuit 123 may set the first voltage detection signal (VDS1), the second voltage detection signal (VDS2), and the third voltage detection signal (VDS3) at Low level (first level), respectively. In the case where the input voltage is higher than the Vdet (within the predetermined voltage range), each of the first voltage detection circuit 121, the second voltage detection circuit 122, and the third voltage detection circuit 123 may set the first voltage detection signal (VDS1), the second voltage detection signal (VDS2), and the third voltage detection signal (VDS3) at High level (second level), respectively. In the case where the detection functions of the first voltage detection circuit 121, the second voltage detection circuit 122, and the third voltage detection circuit 123 are in OFF states, the first voltage detection signal (VDS1), the second voltage detection signal (VDS2), and the third voltage detection signal (VDS3) may be set at High level (second level), respectively.

Upon detection of the power supply abnormality, the gate control signal output circuit 126 may set the abnormality detection signal (ABM) at Low level. In the normal state of the power supply, it may set the abnormality detection signal (ABN) at High level.

What is claimed is:

1. A display device comprising:

a gate line;

a source line;

a gate scanning circuit for driving the gate line;

an external power supply circuit coupled to a first capacitor; and a driver IC including a voltage detection circuit for detecting an output voltage of the external power supply circuit, a voltage generation circuit coupled to a second capacitor having smaller capacitance than that of the first capacitor, a switching circuit for switching between an output voltage of the voltage generation circuit and the output voltage of the external power supply circuit, and a drive circuit for driving the source line, wherein the switching circuit applies the output voltage of the voltage generation circuit to the gate scanning circuit and the drive circuit applies the voltage corresponding to a video signal to the source line when the voltage detection circuit detects a voltage within a predetermined voltage range, and the switching circuit applies the output voltage of the external power supply circuit to the gate scanning circuit when the voltage detection circuit detects a voltage outside of the predetermined voltage range.

2. The display device according to claim 1, wherein, upon detection of the voltage outside of the predetermined voltage range, the voltage detection circuit sets a voltage detection signal at a first level;

upon detection of the voltage within the predetermined voltage range, the voltage detection circuit sets the voltage detection signal at a second level, and based on the voltage detection signal, the switching circuit switches between the output voltage of the voltage generation circuit and the output voltage of the external power supply circuit.

3. The display device according to claim 2, further comprising a storage circuit to change the predetermined voltage range.

4. The display device according to claim 3, wherein the voltage within the predetermined voltage range is higher than the predetermined voltage, and the voltage outside of the predetermined voltage range is equal to or lower than the predetermined voltage.

5. A display device comprising:

a gate line;

a gate scanning circuit for driving the gate line;

a first external power supply circuit coupled to a first capacitor;

a second external power supply circuit and a driver IC including a first voltage detection circuit for detecting an output voltage of the first external power supply circuit, a second voltage detection circuit for detecting an output voltage of the second external power supply circuit, a voltage generation circuit coupled to a second capacitor having smaller capacitance than that of the first capacitor, a switching circuit for switching between an output voltage of the voltage generation circuit and the output voltage of the first external power supply circuit, and a drive circuit for driving the source line, wherein, upon detection of at least one of the voltage outside of a first predetermined voltage range by the first voltage detection circuit and the voltage outside of a second predetermined voltage range by the second voltage detection circuit, the switching circuit applies the output voltage of the first external power supply circuit to the gate scanning circuit.

6. The display device according to claim 5, wherein upon detection of the voltage outside of the first predetermined voltage range, the first voltage detection circuit sets a first voltage detection signal at a first level;

upon detection of the voltage within the first predetermined voltage range, the first voltage detection circuit sets the first voltage detection signal at a second level;

upon detection of the voltage outside of the second predetermined voltage range, the second voltage detection circuit sets a second voltage detection signal at the first level, and upon detection of the voltage within the second predetermined voltage range, the second voltage detection circuit sets the second voltage detection signal at the second level.

7. The display device according to claim 6, wherein in the case where the first voltage detection signal and the second voltage detection signal are set at the first level, the gate scanning circuit selects all the gate lines for outputting the voltage of the first external power supply circuit.

8. The display device according to claim 7, further comprising a source line and a drive circuit for driving the source line, wherein in the case where at least one of the first voltage detection signal or the second voltage detection signal are set at the first level, the drive circuit supplies GND level to all the source lines.

9. The display device according to claim 6, wherein the voltage within the first predetermined voltage range is higher than the first predetermined voltage;

the voltage outside of the first predetermined voltage range is equal to or lower than the first predetermined voltage;

the voltage within the second predetermined voltage range is higher than the second predetermined voltage, and the voltage outside of the second predetermined voltage range is equal to or lower than the second predetermined voltage.

10. The display device according to claim 5, further comprising a storage circuit configured to change both the first and the second predetermined voltage ranges.

11. A system comprising:

a display device;

a power-supply circuit including a first power supply circuit, a second power supply circuit and a third power supply circuit;

a first capacitor coupled to the first power supply circuit;

a second capacitor coupled to the second power supply circuit;

a third capacitor coupled to the third power supply circuit, wherein:

the display device includes a gate line, a source line, a gate scanning circuit for driving the gate line, and a driver IC;

the driver IC includes a first voltage detection circuit for detecting a voltage level of the first power supply circuit, a second voltage detection circuit for detecting a voltage level of the second power supply circuit, a third voltage detection circuit for detecting a voltage level of the third power supply circuit, a voltage generation circuit coupled to a fourth capacitor for generating a first voltage and a second voltage for driving the gate line, a switching circuit for selecting the first and the second voltages or voltages of second and third external power supply circuits, a drive circuit for driving the source line, and a storage circuit;

the fourth capacitor has smaller capacitance than that of the first, second and third capacitances; and in the case where at least one output of the first voltage detection circuit, the second voltage detection circuit, and the third voltage detection circuit is set at the first level, the switching circuit supplies a power supply abnormality signal, the second external voltage and the third external voltage to the gate scanning circuit.

12. The system according to claim 11, wherein, upon detection of the voltage lower than the first voltage, the first voltage detection circuit sets a first voltage detection signal at the first level;

upon detection of the voltage higher than the first voltage, and a voltage detection function set in OFF state, the first voltage detection circuit sets the first voltage detection signal at a second level;

upon detection of the voltage lower than the second voltage, the second voltage detection circuit sets a second voltage detection signal at the first level;

upon detection of the voltage higher than the second voltage, and the voltage detection function set in OFF state, the second voltage detection circuit sets the second voltage detection signal at the second level;

upon detection of the voltage lower than the third voltage, the third voltage detection circuit sets a third voltage detection signal at the first level, and upon detection of the voltage higher than the third voltage, and the voltage detection function set in OFF state, the third voltage detection circuit sets the third voltage detection signal at the second level.

13. The system according to claim 12, wherein in the case where the power supply abnormality signal is set at the first level, the gate scanning circuit selects all the gate lines for outputting the second external voltage to the gate lines.

14. The system according to claim 13, wherein in the case where the power supply abnormality signal is set at the first level, the drive circuit supplies GND level to all the source lines.

15. The system according to claim 14, wherein the storage circuit allows change in the first voltage, the second voltage, the third voltage, ON/OFF state of the voltage detection function of the first voltage detection circuit, ON/OFF state of the voltage detection function of the second voltage detection circuit, and ON/OFF state of the voltage detection function of the third voltage detection circuit, respectively.

16. The system according to claim 15, wherein the first power supply voltage is a logic power supply voltage of the driver IC;

the second power supply voltage is an analog positive power supply voltage of the driver IC, and the third power supply voltage is an analog negative power supply voltage of the driver IC.

* * * * *